United States Patent [19]

Acres et al.

[11] 4,221,542

[45] Sep. 9, 1980

[54] SEGMENTED BLADE RETAINER

[75] Inventors: Ronald C. Acres, Hamilton; Robert D. Gravitt; Robert H. Roth, both of Cincinnati, all of Ohio

[73] Assignee: General Electric Company, Cincinnati, Ohio

[21] Appl. No.: 864,950

[22] Filed: Dec. 27, 1977

[51] Int. Cl.[2] ..... F01D 5/32

[52] U.S. Cl. ..... 416/220 R; 416/193 A

[58] Field of Search ..... 416/220 R, 220 A, 221, 416/212 A, 219 R

[56] References Cited

U.S. PATENT DOCUMENTS

| | | | |
|---|---|---|---|
| 2,994,507 | 8/1961 | Keller et al. | 416/221 |
| 3,137,478 | 6/1964 | Farrell | 416/193 A |
| 3,216,699 | 11/1965 | Schoenborn | 416/220 |
| 3,383,095 | 5/1968 | Anderson | 416/220 |
| 3,653,781 | 4/1972 | Cooper | 416/221 |
| 3,832,092 | 8/1974 | Manharth | 416/220 |
| 3,888,601 | 6/1975 | Glassburn | 416/220 |
| 3,936,234 | 2/1976 | Tucker et al. | 416/220 |

FOREIGN PATENT DOCUMENTS

| | | | |
|---|---|---|---|
| 2345605 | 10/1977 | France | 416/220 |
| 894704 | 4/1962 | United Kingdom | 416/220 |

*Primary Examiner*—Everette A. Powell, Jr.
*Assistant Examiner*—A. N. Trausch, III
*Attorney, Agent, or Firm*—Dana F. Bigelow; Derek P. Lawrence

[57] ABSTRACT

A shrouded blade for insertion into an axial disk slot and having a radial spacer and a circumferential groove is provided with a segmented retainer bar which fits into the circumferential groove to axially retain the blade. The retainer bar includes flanges which extend radially inward on either side of the spacer such that the spacer provides positive placement for the retainer bar in both the radial and circumferential directions.

11 Claims, 6 Drawing Figures

3
3
27
12
30
25
15
20
22
14
23
19
16
11
17
13
18

27
28
27
12
12
L
26
26
22
21
19
24
22
38
X
d
11
16
13

12
12
27
29
27
31
28

23
22
30
24
23
12
26
22
14
33
34
19
32
21
39
11
12
26
40
22
41
39
42

SEGMENTED BLADE RETAINER

BACKGROUND OF THE INVENTION

This invention relates generally to turbomachines and, more particularly, to means for axially retaining blades in a rotary disk thereof.

Retention of aerodynamic blades within the periphery of a turbomachinery rotor disk has long been a problem for the industry. The most common method of retaining blades in the disk is by a combination of dovetailed blades and axial slots in the periphery of the disk. This method has been found quite satisfactory and desirable for purposes of withstanding the radial loads caused by centrifugal force. However, since there are considerable axial forces on the blades, there is a necessity to provide for axial retention thereof in both directions. In this connection, it is desirable to minimize weight, windage, and stress concentrations while providing a retention means which is simple and relatively easy to assemble and disassemble. That is, for maintainability and repair purposes, it must be relatively easy to remove and replace a single blade.

For the purpose of enhancing blade stability, it has become common practice to use interengaging shrouds, either at the midspan or at the tip of adjacent blades. These act to dampen vibration and to prevent blade untwist during loading. However, where the adjacent shrouds interlock so as to interengage in both axial directions, as is usually the case, then a blade may not be simply assembled by the mere axial insertion into the disk slot. It has become common practice to insert a blade into the lower portion of the disk slot and then raise it radially outward to engage the adjacent interlocking shrouds, and then to fix the blade in that position by the use of a spacer which is placed in the slot under the blade dovetail.

A known method for axially retaining the blade in its slot is to form a circumferential groove near one end of the dovetail, align it circumferentially with a groove or pair of grooves on the disk, and place a ring through both the dovetail groove and the disk groove to lock it into its axial position. However, it has been found that such a ring, which by the very nature of its function must be flexible, did not provide the necessary strength requirement for axial blade retention. On the other hand, to replace the ring with individual segments would require additional means for maintaining those segments in position both radially and circumferentially.

It is therefore an object of the present invention to provide an improved axial retention method for a shrouded blade.

Another object of the present invention is the provision for an axial retainer with increased strength capabilities.

Yet another object of the present invention is the provision in a blade retainer apparatus for a segmented retainer element.

Still another object of the present invention is the provision in a retainer apparatus for maintaining positive positioning for a segmented retainer element.

Yet another object of the present invention is the provision for a blade retaining apparatus which is relatively simple, light in weight and easy to assemble.

These objects and other features and advantages become more readily apparent upon reference to the following description when taken in conjunction with the appended drawings.

SUMMARY OF THE INVENTION

Briefly, in accordance with one aspect of the invention, a retainer bar is placed in a circumferential groove near one end of the blade dovetail and the radial spacer is placed contiguous with the radially inner face of the blade dovetail so as to entrap the retainer bar and prevent its movement in the radially inward direction. The retainer bar has flanges extending radially inwardly, on either side of the spacer element such that the spacer element also provides circumferential positioning for the retainer bar. Each blade therefore has its own individual spacer and retainer bar, thereby facilitating assembly and disassembly and allowing the use of a substantially large retainer bar made from a high strength material which is not necessarily flexible.

By another aspect of the invention, the maximum circumferential distance between the radially extending flanges of the retainer bar is slightly greater than the circumferential width of that portion of the spacer element which fits into the disk slot to thereby provide a track for axial insertion of the spacer. By yet another aspect of the invention, the retainer bar includes opposing flanges extending circumferentially inward from its radially extending flanges to define a locking slot therebetween. This slot is adapted to receive a channel portion on one end of the spacer element which has a slightly smaller circumferential length, to thereby lock the retainer bar in its circumferential position when both it and the spacer are in their finally assembled position.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
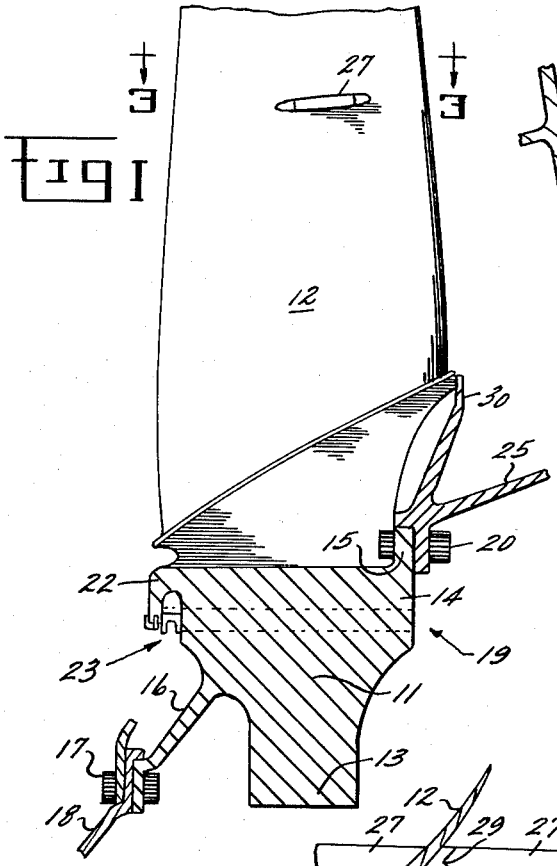
FIG. 1 is a partial, longitudinal cross-sectional view of a blade installed in a rotary disk in accordance with the preferred embodiment of the invention.
Figure 2:
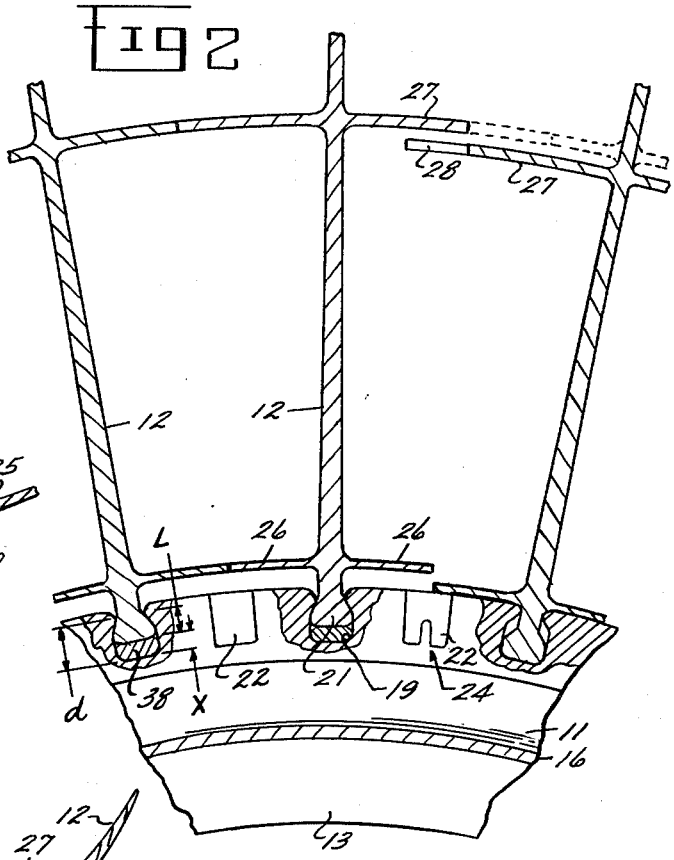
FIG. 2 is a partial, axially cross-sectional view of a plurality of blades during an intermediate step in their assembly in accordance with the preferred embodiment of the invention.

Referring to FIGS. 1 and 2, there is shown a fan disk 11 and a plurality of circumferentially spaced, radially extending fan blades 12 to be secured in the periphery of the disk 11 by way of the present invention. The disk 11 comprises a radially inner, load carrying portion 13 and a radially outer, blade retention portion 14. The load carrying portion 13 is mechanically connected to a central shaft which is rotated by a low pressure turbine (not shown) in a conventional manner. On the forward face of the disk, intermediate the load carrying portion 13 and the blade retention portion 14 is a support cone 16 which is connected by a plurality of fasteners 17 to a shaft 18 for the purpose of supporting the rotor 13. On the aft face of the disk is provided a flange 15 which is connected by a plurality of fasteners 20 to the torque transmitting member 25. Integral to the torque transmitting member 25 is an air seal 30 which extends radially outward to engage an intermediate portion of the blade 12.

Formed in the blade retention portion 14 of the disk 11 is a plurality of circumferentially spaced dovetail or disk slots 19, each of which is adapted to receive by insertion in the axial direction a dovetail 21 on the radially inner end of the blade. The effective radial depth, or the radial distance between the bottom of the slot and the radially outermost portion which acts to contain the blade, is designated as D. The dovetail effective length, or the distance between the radially inner end and the radially outermost portion which is engagingly retained by the disc, is designated as L. It will be recognized in FIG. 2 that the dovetail slot effective radial depth D is greater than the dovetail effective length L by a dimension X, the purpose of which will be more clearly described hereinafter.

Also forming part of the disk is a plurality of hooks 22 extending forward from the forward face of the disk and then radially inward to define a circumferential groove or disc slot means 23 between the hook and the forward face of the disk. There is also an axially extending groove 24 formed in the hook as shown in FIG. 2. The hooks and associated grooves form part of the retention system as will be more fully described hereinafter.

Figure 3:
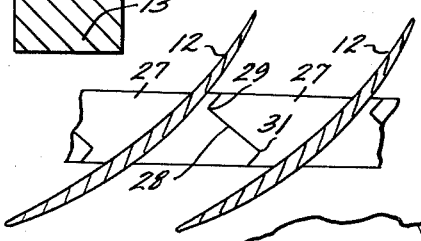
FIG. 3 is a cross-sectional view showing the shroud interlocks of adjacent blades as seen along lines 3—3 of FIG. 1.

Each of the blades 12 has near its dovetail end a platform 26 which extends circumferentially on either side thereof to mate with the platforms of the adjacent blades. The platforms in combination form the inner boundary for the airflow which is created by rotation of the blades 12. In a similar manner, proximate the midspan portion of each of the blades, a midspan shroud 27 extends circumferentially on either side of the blade to interlock with the midspan shrouds of the adjacent blades. As can be seen in FIG. 3, the interlocking edge 28 is formed in such a manner as to restrict relative movement in either axial direction. A particular profile shown is one having both an angled projection 29 and an angled recess 31. It will, of course, be recognized that various other configurations could be employed for the purpose of restricting relative movement in both axial directions. Such an interlocking arrangement, of course, prevents the assembly of adjacent blades by a simple relative movement of adjacent blades in the axial direction, and instead requires a relative radial movement of adjacent blades for interlocking assembly. The present invention allows for such an assembly while still using the dovetail and slot at the radially inner portion of the blade.

Figure 4:
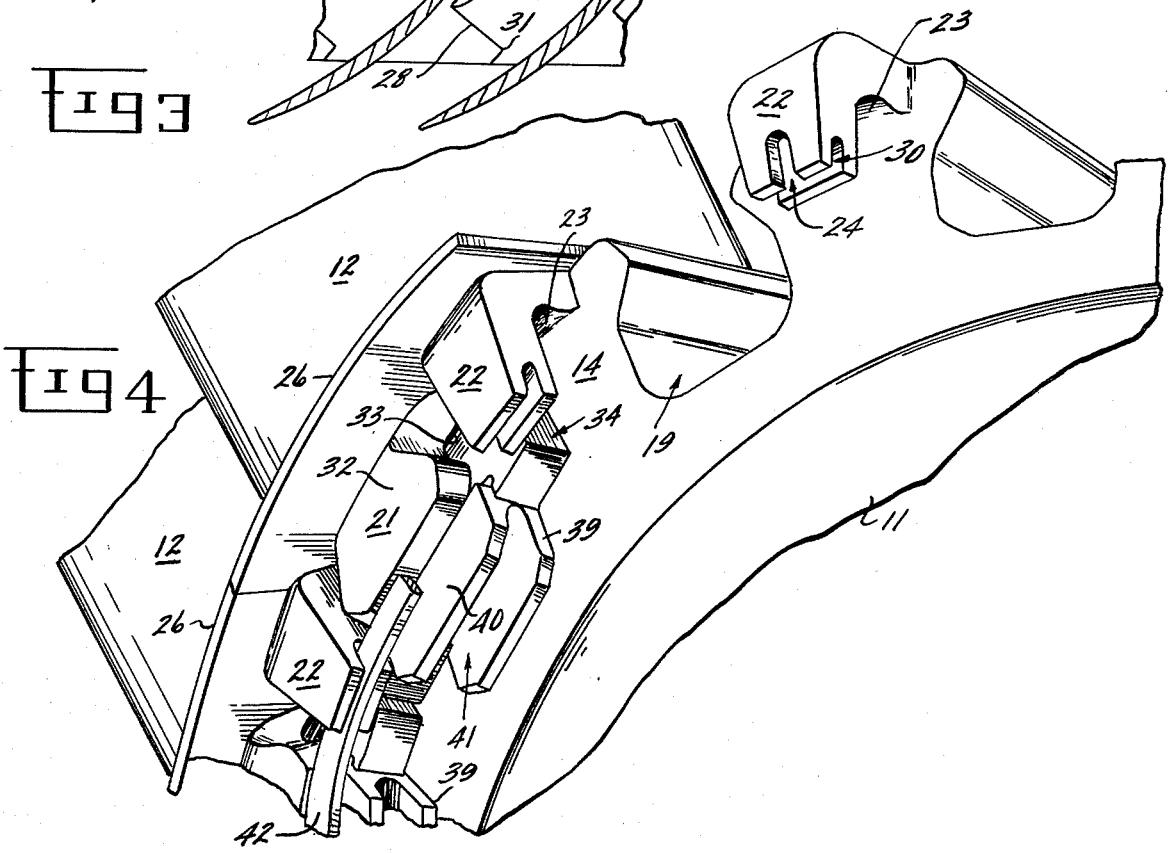
FIG. 4 is a partial perspective view showing a pair of blades in their finally assembled positions.

Referring now to FIG. 4, one can more clearly see the blade retention portion 14 of the disk with its plurality of circumferentially spaced and alternately arranged dovetail slots 19 and hooks 22. The circumferential grooves 23 defined by the hooks 22 and the forward face of the blade retention portion 14 are employed for retaining the blades 12 from movement within their slots 19 in either of the axial directions as will be more fully described hereinafter. As will be seen, in addition to the circumferential groove 23, each of the hooks 22 has formed therein, at their free end, a circumferential slot 30 for receiving a retainer ring. A single hook 22 has formed therein an axial slot 24 for receiving a portion of the retainer ring as will be described hereinafter.

Figure 5:
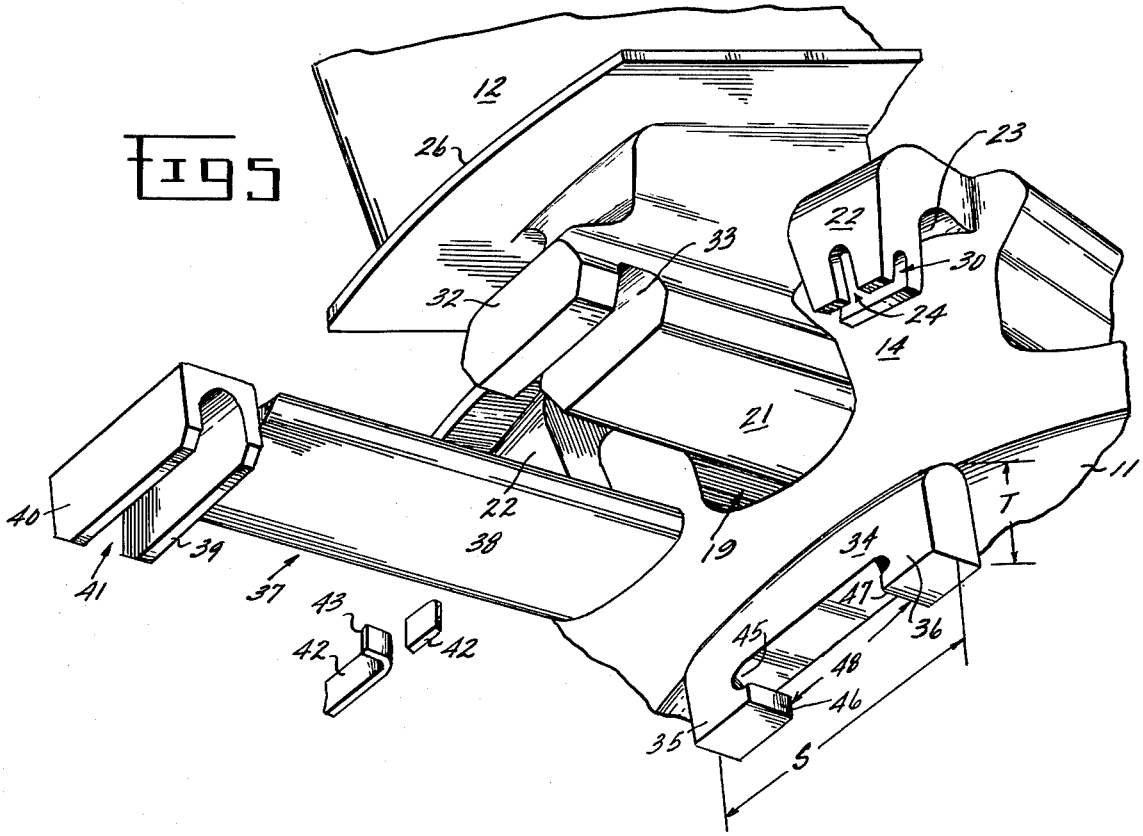
FIG. 5 is a partial exploded view of the retainer assembly.

Referring now to FIG. 5, the disk blade retention portion 14 and a single blade 12 are shown in exploded positions with the related elements employed for the blade retention. It will be seen that the blade dovetail has formed therein, near the forward face 32 thereof, a circumferential groove or blade slot means 33. When an individual blade is in its installed position, the circumferential groove 33 of the dovetail is circumferentially aligned with the circumferential groove 23 of the adjacent hooks 22. In order to interconnect the blade dovetails and the disc hooks, by way of the respective grooves, a retaining bar 34 is provided to be simultaneously placed in the dovetail and disk circumferential grooves 33 and 23, respectively. The circumferential length S of the retaining bar is such that it extends into each of the circumferential grooves 23 on either side of the associated blade dovetail 21. In this way, each blade dovetail 21 has its own retainer bar 34 to prevent movement of the dovetail in its slot in either axial direction. Each hook 22 then acts to receive and retain in the axial direction a retainer bar on either side thereof. Axial movement of the retainer bar is prevented in one direction by the hook itself and in the other direction by the face of the disk. The radial depth T of the retaining bar 34 is sufficient to fill the circumferential groove 33 and to extend radially inward thereof by way of a pair of flanges 35 and 36 which define the circumferential limits of an axial groove 45. Extending radially inward from the ends of the flanges 35 and 36 are opposing flanges 46 and 47 to define a locking slot 48 therebetween. Both the axial groove 45 and the locking slot 48 are sized to receive mating sections of a spacer element 37.

The spacer element 37 is an elongate member having a spacer portion 38 and a channel portion 39. The spacer portion 38 is designed to fit first into the axial groove 45 of the retainer bar 34 and then into the dovetail slot 19, between the radially inner side of the blade dovetail 21 and the blade retention portion 14 of the disk 11. Its radial depth is therefore, in at least one place, substantially equal to the dimension X of FIG. 2 such that when it is in the installed position, the blade dovetail is helt tightly in its radially outer position. It may of course be tapered to facilitate easy insertion into the slot. The width of the spacer portion 38 is slightly smaller than that of the axial groove 45 of the retainer bar 34 such that the retainer bar 34 slideably receives the spacer element 37. The close fit of spacer element 37 in axial groove 45 of the retainer bar 34 provides positive placement of the retainer bar 34.

Figure 6:
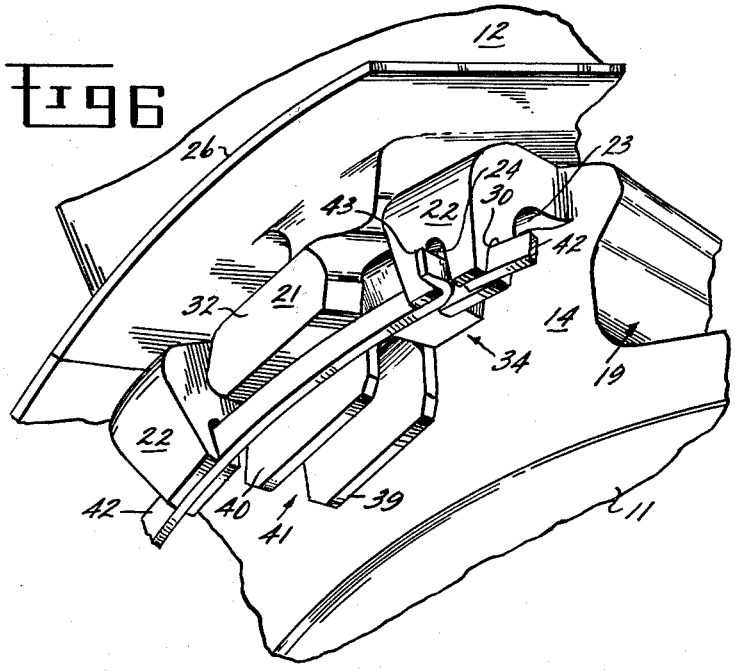
FIG. 6 is a partial perspective view thereof with the components in their assembled position.

The channel portion 39 comprises a U-channel with its open end facing radially inward to define a circumferential channel 41 which reduces weight and accommodates removal of the spacer element 37. The circumferential length of the U-channel portion 39 is such that when the spacer element 37 is in the installed position, the U-channel will fit securely in the locking slot 48 to further secure the retainer bar 34 in the circumferential direction. Further, when the spacer element 37 is in the installed position, the channel face 40 will be axially aligned near the axial plane of the circumferential slots 30 of the hooks 22 on adjacent sides thereof. Axial retention of the spacer element 37 is then provided by a retainer ring 42 which extends alternately across the channel faces 40 and through the circumferential slots 30 around the circumference of the disc. An axial extension 43 is provided on one end of the retainer ring 42 for placement in the axial slot 24 of the single hook 22 a as shown in FIG. 6. The single retainer ring 42 then retains the plurality of spacer elements 37 which in turn hold their respective blades in their radially outer positions such that their midspan shrouds 27 remain in the interlocked positions.

The method of assembly of the above-described elements will be as follows. A first blade will be axially inserted into its dovetail slot to the point where its circumferential groove 33 is aligned with the circumferential grooves 23 on either side thereof. A retainer bar 34 will be inserted in the three grooves and a spacer element 37 will be inserted first into the axial groove 45 of the retainer bar 34 and then further into the dovetail slot 19 between the dovetail 21 and the radially inner surface of the disk slot to thereby rigidly fix the blade in the radially outward position. The adjacent blade is then inserted into its slot, with its dovetail at the radially inner portion of the dovetail slot as shown in FIG. 1. This allows the midspan shrouds 27 to be axially aligned as shown in FIG. 3. A second retainer bar 34 and associated spacer element 37 is inserted in a manner similar to the first such that the blade is moved up into the radially outer position with the midspan shroud 27 becoming interlocked with that of the first blade. This process is continued until all the blades have been inserted into the disk, whereupon the retainer ring 42 is placed in a position to pass through each of the hook circumferential slots 30 and across each of the channel faces 40 of the spacer element 37. The axial extension 43 of the retainer ring 42 is then placed in the axial slot 24 of the single hook 22 to thereby prevent the ring from rotating. Removal of any one of the blades can be accomplished by first removing the retainer ring 42 and then removing the associated spacer element 37 and retainer bar 34 to allow the blade dovetail to drop down into the lower part of the slot to thereby disengage the midspan shrouds 27 and allow the blade to be moved axially from the disk slot.

It will be understood that the present invention has been described in terms of a particular embodiment, but may take on any number of other forms while remaining within the scope and intent of the invention.

Having thus described the invention, what is claimed as novel and desired to be secured by Letters Patent of the United States is:

1. An improved blade retention system of the type having a disk and a plurality of shrouded blades with each blade having a radial spacer to secure the blade dovetail in an axial dovetail slot of the disk, wherein the improvement comprises:

(a) A disk slot formed on one face of the disk, said disk slot comprising a plurality of disk hooks, each having a radially inwardly extending element to define a disk slot portion between that element and the face of the disk;

(b) a blade slot formed near one end of the blade dovetail, said blade slot comprising a plurality of blade hooks each having a radially inwardly extending element to define a blade slot portion which is axially alignable with a pair of said disk slot portions;

(c) a segmented retainer bar interconnecting said blade slot portion and said pair of disk slot portions to maintain their relative axial alignment; and (d) means for retaining said retainer bar in its interconnecting position.

2. An improved blade retention system as in claim 1 wherein each of said disk slot portions comprises a disk hook disposed circumferentially between a pair of adjacent dovetail slots.

3. An improved blade retention system as in claim 1 wherein said blade slot extends circumferentially through the entire blade dovetail.

4. An improved blade retention system as in claim 1 wherein retainer bar passes through said blade slot portion and extends circumferentially outward on either side thereof.

5. An improved blade retention system as in claim 4 wherein said retainer bar extends circumferentially through the entire blade slot portion and a part of each of said pair of disk slot portions.

6. An improved blade retention system as in claim 1 wherein said retainer bar extends from one disk hook, through said blade slot portion, to the adjacent disk hook.

7. An improved blade retention system as in claim 6 wherein said retainer bar extends from the circumferential midpoint of one disk hook to the circumferential midpoint of the adjacent disk hook.

8. An improved blade retention system as in claim 1 wherein said means for retaining said retainer bar includes a portion of the radial spacer which, when in its final position, is disposed radially inward of and engaging said retainer bar to hold said retainer bar in its radial position.

9. An improved blade retention system as in claim 1 wherein said means for retaining said retainer bar includes circumferential interengaging means between said retainer bar and the radial spacer such that the radial spacer retains said retainer bar in the circumferential direction.

10. An improved blade retention system as in claim 1 wherein said retainer bar has an axial groove formed therein for receiving said spacer element such that the spacer element provides positive positioning for said retainer bar.

11. An improved blade retention system as in claim 1 wherein said retainer bar includes a pair of circumferentially opposing flanges to define a locking gap therebetween and the spacer has a portion which, when in its final position, is disposed in said locking gap to secure said retainer bar circumferentially.

* * * * *